United States Patent [19]

Wahle et al.

[11] Patent Number: 5,013,327

[45] Date of Patent: May 7, 1991

[54] MERCERIZING AND/OR CAUSTICIZING WETTING AGENT: 2-ETHYL-HEXYL-SULFATE AND MIXTURE OF ALKYL END-BLOCKED POLYETHERS

[75] Inventors: Bernd Wahle, Kaarst; Faize Selen, Duesseldorf, both of Fed. Rep. of Germany

[73] Assignee: Henkel Kommanditgesellschaft auf Aktien, Duesseldorf-Holthausen, Fed. Rep. of Germany

[21] Appl. No.: 376,089

[22] Filed: Jul. 6, 1989

[30] Foreign Application Priority Data

Jul. 11, 1988 [DE] Fed. Rep. of Germany ..... 3823454

[51] Int. Cl.[5] ..... B01F 17/02; D06M 11/40; D06M 13/26; D06M 15/53

[52] U.S. Cl. ..... 8/125; 8/127.1; 252/8.6; 252/8.7; 252/8.9

[58] Field of Search ..... 8/125, 127.1; 252/8.7, 252/8.9

[56] References Cited

U.S. PATENT DOCUMENTS 4,548,729 10/1985 Schmid et al. ..... 252/174.21

FOREIGN PATENT DOCUMENTS 303928 2/1989 European Pat. Off. .
3744525 12/1988 Fed. Rep. of Germany .
3800490 7/1989 Fed. Rep. of Germany .
732427 5/1980 U.S.S.R. .

*Primary Examiner*—A. Lionel Clingman
*Attorney, Agent, or Firm*—Ernest G. Szoke; Wayne C. Jaeschke; Real J. Grandmaison

[57] ABSTRACT

Mercerizing and/or causticizing wetting agent compositions containing alkali metal and/or ammonium salts of 2-ethyl hexyl sulfate, a mixture of terminally blocked polyethers and, optionally, trialkyl phosphates.

13 Claims, No Drawings

MERCERIZING AND/OR CAUSTICIZING WETTING AGENT: 2-ETHYL-HEXYL-SULFATE AND MIXTURE OF ALKYL END-BLOCKED POLYETHERS

BACKGROUND OF THE INVENTION

1. Field of the Invention

This invention relates to a mercerizing and/or causticizing wetting agent composition containing alkali metal and/or ammonium salts of 2-ethyl hexyl sulfate, terminally blocked polyethers and, optionally, trialkyl phosphates.

The object of mercerizing and causticizing cotton, i.e. the treatment of cellulose with lyes of different concentration, is to provide the fibers with better gloss effects, with increased receptivity for dyes, greater tensile strengths and a softer, fuller feel. However, the concentrated caustic soda used in practice does not have a particularly high wetting power. In addition, wetting is hindered by the hydrophobic substances adhering to the cellulose fibers. Accordingly, wetting agents are frequently added to the mercerizing and/or causticizing liquors to obtain a fast and uniform reaction of the lye with the cellulose (Chwala/Anger: "Handbuch der Textilhilsmittel", pages347-350, 1977).

Besides having high wetting power, the wetting agents must not cause any foaming in the liquors, must be stable over a wide alkali concentration range and must show very good biodegradability. However, most of the known mercerizing and/or causticizing wetting agents do not effectively satisfy these stringent requirements. For example, the salts of 2-ethyl hexyl sulfate frequently used as wetting agents tend to cause excessive foaming in mercerizing and/or causticizing liquors.

German Pat. No. 12 45 898 describes mixtures of branched-chain carboxylic acid esters, phosphoric acid esters of aliphatic alcohols, fatty acids or soaps and alkoxylated compounds or alkyl sulfuric acid esters as low-foaming wetting agents. In addition, it is known from Chemical Abstracts, Ca 93, 115887 g - (1980) that fatty alcohols alkoxylated with 20 mol of ethylene oxide in combination with 2-ethyl hexyl sodium sulfate improve the wetting power of mercerizing liquors and reduce foaming therein.

Terminally blocked alkyl alcohol ethoxylates are known as foam-reducing additives in low-foaming cleaning preparations from German Pat. Nos. 33 15 951, 37 27 378 and 38 00 490.

The problem addressed by the present invention is to provide low-foaming, alkali-stable and readily biodegradable mercerizing and/or causticizing wetting agents of high shrinkage wetting power.

DESCRIPTION OF THE INVENTION

Other than in the operating examples, or where otherwise indicated, all numbers expressing quantities of ingredients or reaction conditions used herein are to be understood as modified in all instances by the term "about."

It has now surprisingly been found that wetting agents containing alkali metal and/or ammonium salts of 2-ethyl hexyl sulfate, particular terminally blocked polyethers and, optionally, trialkyl phosphates substantially satisfy the stringent demands made of them.

Accordingly, the present invention relates to a mercerizing and/or causticizing wetting agent composition comprising 15 to 30% by weight alkali metal and/or ammonium salts of 2-ethyl hexyl sulfate, 1 to 10% by weight of a mixture of terminally blocked polyethers corresponding to the following general formulae $$R^1-\underset{\underset{R^2}{|}}{CH}-CH_2-O-(C_nH_{2n}O)_x-R^3 \qquad (A)$$

in which $R^1$ is a linear $C_{1-20}$ alkyl radical, $R^2$ is a linear $C_{1-20}$ alkyl radical and $R^3$ is a $C_{1-22}$ alkyl, alkenyl, cycloalkyl, aryl, arylalkyl or alkylaryl radical and n is the number 2, 3 or 4, and x is a number of 2 to 25, and $$R^4-O-(C_nH_{2n}O)_x-R^3 \qquad (B)$$

in which $R^4$ is a $C_{8-22}$ alkyl or alkenyl radical and $R^3$ is a $C_{1-22}$ alkyl, alkenyl, cycloalkyl, aryl, arylalkyl or alkylaryl radical, n is the number 2, 3 or 4, and x is a number of 2 to 25, and 0 to 5% by weight trialkyl phosphates containing 1 to 6 carbon atoms in the alkyl groups.

The mercerizing and/or causticizing wetting agents according to the invention preferably contain terminally blocked polyethers corresponding to general formulae A and B, in which $R^1$ is a linerar $C_{8-12}$ alkyl radical, $R^2$ is a linear $C_{6-10}$ alkyl radical, $R^3$ is a $C_{1-6}$ alkyl radical and $R^4$ is a $C_{12-18}$ alkyl or alkenyl radical, n is the number 2 and x is a number of 2 to 10. The ratio by weight between the terminally blocked polyethers A and B is preferably between 0.1 and 10, and more preferably between 0.9 and 1.1.

The terminally blocked polyethers corresponding to general formula A may be obtained by known methods. Guerbet alcohols prepared by reaction of saturated primary $C_{1-20}$ alcohols in the presence of alkali (cf. for example Angew. Chem. 64, 213-220 (1952)) are alkoxylated with ethylene oxide, propylene oxide and/or butylene oxide, preferably ethoxylated ("Chemische Technologie", Vol. 7, pages 131-132, Carl-Hanser-Verlag, München-Wien (1986)), and are then preferably reacted with $C_{1-6}$ alkyl halides, for example methyl chloride, ethyl chloride, propyl chloride, butyl chloride, butyl bromide, pentyl chloride and/or hexyl chloride at a temperature in the range from 60° to 140° C. (German Pat. No. 37 44 525). Examples of the alcohols required for the preparation of Guerbet alcohols are capryl, capric, lauryl, myristyl, cetyl, stearyl alcohol and mixtures of these alcohols.

The terminally blocked polyethers corresponding to general formula B may also be prepared by methods known from the literature. The educts used are aliphatic, saturated and/or unsaturated $C_{8-22}$ alcohols of natural and/or synthetic origin, for example octyl, decyl, dodecyl, myristyl, cetyl, stearyl, oleyl, linoleyl, behenyl, erucyl alcohol or mixtures of these alcohols. $C_{12-18}$ alcohols, for example lauryl, myristyl, cetyl, stearyl, oleyl alcohol and mixtures thereof are preferred. The alkoxylation of these alcohols with ethylene oxide, propylene oxide and/or butylene oxide, preferably with ethylene oxide, is carried out by known industrial methods (cf. for example "Chemische Technologie" Vol. 7, pages 131-132, Carl-Hanser-Verlag, Müchen-Wien (1986)). The alkoxylated alcohols are then reacted in known manner with, preferably, $C_{1-6}$ alkyl halides, for example methyl chloride, ethyl chloride, propyl chloride, butyl chloride, butyl bromide, pentyl chloride and/or hexyl chloride to form the terminally blocked polyethers.

The alkali metal and/or ammonium salts of 2-ethyl hexyl sulfate present in the wetting agents according to the invention are commercially available products, for example Texapon ® EHS, a product of Henkel KGaA.

The trialkyl phosphates optionally present in the wetting agents according to the invention are prepared in known manner, for example by reaction of phosphorus oxychloride with alkyl alcohols (Chem. and Ind. 1962, 1032–1035). The alcohols used are, for example, methanol, ethanol, propanol, n-butanol, n-pentanol or n-hexanol. The wetting agents according to the invention preferably contain from 0.5 to 5% by weight trialkyl phosphates.

The wetting agents according to the invention are prepared at 18° to 50° C. by stirring the individual components, optionally after melting, to form a homogeneous solution.

The wetting agents according to the invention, which are present in the form of aqueous solutions are distinguished by high shrinkage wetting power and minimal foaming. In addition, they show very good biodegradability. The wetting agents according to the invention contain only small quantities, if any, of solvents, such as polyalcohols, for example hexylene glycol and/or butylene glycol.

By virtue of their stability over a wide alkali concentration range, the wetting agents according to the invention may be used both for mercerizing and for causticizing, for example, cellulose-containing woven fabrics, knitted fabrics and/or yarns. The content of wetting agents according to the invention in the mercerizing and/or causticizing liquors is between 2 and 12 g/l liquor.

EXAMPLES

1. Preparation of mercerizing and/or causticizing wetting agents according to the invention (a) 81% by weight 2-ethyl hexyl sulfate, sodium salt (active substance content: 30% by weight, water content: 70% by weight)

2.5% by weight $C_{12-18}$ fatty alcohol. 5 mol ethylene oxide-butyl ether 2.5% by weight 2-hexyl-1-decanol. 6 mol ethylene oxide-butyl ether 2% by weight n-tributyl phosphate 4% by weight hexylene glycol 8% by weight water (b) 81% by weight 2-ethyl hexyl sulfate, sodium salt (active substance content 30% by weight, water content 70% by weight)

2.5% by weight $C_{12-18}$ fatty alcohol. 5 mol ethylene oxide-butyl ether 2.5% by weight 2-octyl-1-dodecanol. 8 mol ethylene oxide-butyl ether 2% by weight n-tributyl phosphate 4% by weight hexylene glycol 8% by weight water (c) 81% by weight 2-ethyl hexyl sulfate, sodium salt (active substance content 30% by weight, water content 70% by weight)

2.5% by weight $C_{12-18}$ fatty alcohol. 7 mol ethylene oxide-butyl ether 2.5% by weight 2-octyl-1-dodecanol. 8 mol ethylene oxide-butyl ether 2% by weight n-tributyl phosphate 4% by weight hexylene glycol 8% by weight water

Shrinkage wetting power of the wetting agents according to the invention

The shrinkage wetting power was determined in accordance with DIN 53987 (Landolt method) at 18° C. using a quantity of wetting agent of 5 g/l (shrinkage power expressed in %).

TABLE 1

| | Time in seconds | | | | | | |
|---|---|---|---|---|---|---|---|
| | 10 | 20 | 30 | 40 | 50 | 60 | 90 |
| Caustic soda 20° Be (16.7% by weight) | | | | | | | |
| wetting agent 1 a | 13 | 17.5 | 20 | 21 | 22 | 23 | 25 |
| wetting agent 1 b | 11.5 | 16 | 18 | 20 | 21.5 | 22 | 23 |
| wetting agent 1 c | 11 | 15.5 | 18 | 19 | 20.5 | 21.5 | 23 |
| Commercial product based on 2-ethyl hexyl sulfate, sodium salt | 10 | 15 | 17 | 19 | 20 | 20.5 | 20.5 |
| Caustic soda 22° Be (25.6% by weight) | | | | | | | |
| wetting agent 1 a | 14 | 18 | 20.5 | 22 | 22.5 | 23 | 25 |
| wetting agent 1 b | 15 | 19 | 21 | 23 | 24 | 24.5 | 26 |
| wetting agent 1 c | 13 | 17 | 19 | 21 | 22 | 23 | 24 |
| Commercial product based on 2-ethyl hexyl sulfate, sodium salt | 14 | 17.5 | 19 | 20.5 | 21 | 22 | 23.5 |
| Caustic soda 25° Be (29.7% by weight) | | | | | | | |
| wetting agent 1 a | 17 | 22 | 24 | 24 | 25 | 25 | 26 |
| wetting agent 1 b | 19 | 24 | 26 | 27 | 28 | 28.5 | 29 |
| wetting agent 1 c | 16 | 22 | 24 | 25 | 25.5 | 26 | 27 |
| Commercial product based on 2-ethyl hexyl sulfate, sodium salt | 18 | 23 | 24 | 25 | 25 | 26 | 26 |
| Caustic soda 28° Be (35% by weight) | | | | | | | |
| wetting agent 1 a | 15 | 21 | 23 | 23.5 | 24 | 24 | 25 |
| wetting agent 1 b | 17 | 25.5 | 27 | 28 | 28 | 28.5 | 29 |
| wetting agent 1 c | 11 | 17 | 20 | 21.5 | 22 | 23 | 24 |
| Commercial product based on 2-ethyl hexyl sulfate, | 14 | 20 | 22 | 22 | 23 | 23 | 24 |

TABLE 1-continued

| | Time in seconds | | | | | | |
|---|---|---|---|---|---|---|---|
| | 10 | 20 | 30 | 40 | 50 | 60 | 90 |
| sodium salt | | | | | | | |
| Caustic soda 30° Be (38.9% by weight) | | | | | | | |
| wetting agent 1 a | 4 | 12 | 17 | 20 | 22 | 23 | 24 |
| wetting agent 1 b | 5 | 12.5 | 18 | 20 | 22 | 22.5 | 24.5 |
| wetting agent 1 c | 5 | 12 | 15.5 | 20 | 21 | 22 | 24 |
| Commercial product based on 2-ethyl hexyl sulfate, sodium salt | 10 | 21 | 22 | 24 | 25 | 25 | 25.5 |
| Caustic soda 32° Be (42.8% by weight) | | | | | | | |
| wetting agent 1 a | 2 | 5 | 8 | 10 | 13 | 14 | 18 |
| wetting agent 1 b | 4 | 7 | 11 | 14 | 16 | 16.5 | 20 |
| wetting agent 1 c | 5 | 12 | 15.5 | 20 | 21 | 22 | 24 |
| Commercial product based on 2-ethyl hexyl sulfate, sodium salt | 3 | 9 | 14.5 | 17 | 19.5 | 21 | 22 |

Foaming power of the wetting agents according to the invention

Foaming power was determined at 18° C. by the glass frit method described in Melliand Textilberichte 48, pp. 311–315 and 450–456 using a quantity of wetting agent of 5 g/l. The foam height is expressed in mm (200 mm is the maximum height under the test conditions).

TABLE 2

| | Time in minutes | |
|---|---|---|
| | 1 | 60 |
| Caustic soda 20° Be (16.7% by weight) | | |
| wetting agent 1 a | 35 | 40 |
| wetting agent 1 b | 35 | 60 |
| wetting agent 1 c | 30 | 35 |
| Commercial product based on 2-ethyl hexyl sulfate, sodium salt | >200 | — |
| Caustic soda 22° Be (25.6% by weight) | | |
| wetting agent 1 a | 40 | 100 |
| wetting agent 1 b | 50 | 125 |
| wetting agent 1 c | 35 | 50 |
| Commercial product based on 2-ethyl hexyl sulfate, sodium salt | >200 | — |
| Caustic soda 25° Be (29.7% by weight) | | |
| wetting agent 1 a | 50 | 200 |
| wetting agent 1 b | 40 | 200 |
| wetting agent 1 c | 50 | 120 |
| Commercial product based on 2-ethyl hexyl sulfate, sodium salt | >200 | — |
| Caustic soda 28° Be (35% by weight) | | |
| wetting agent 1 a | 35 | 35 |
| wetting agent 1 b | 35 | 35 |
| wetting agent 1 c | 30 | 70 |
| Commercial product based on 2-ethyl hexyl sulfate, sodium salt | 100 | >200 |
| Caustic soda 30° Be (38.9% by weight) | | |
| wetting agent 1 a | 35 | 35 |
| wetting agent 1 b | 35 | 35 |
| wetting agent 1 c | 35 | 35 |
| Commercial product based on 2-ethyl hexyl sulfate, sodium salt | 100 | 200 |
| Caustic soda 32° Be (42.8% by weight) | | |
| wetting agent 1 a | 35 | 35 |
| wetting agent 1 b | 35 | 35 |
| wetting agent 1 c | 35 | 35 |
| Commercial product based on 2-ethyl hexyl sulfate, sodium salt | 20 | 120 |

We claim:

1. A mercerizing or causticizing wetting agent composition comprising from about 15 to about 30% by weight of an alkali metal or ammonium salt of 2-ethyl hexyl sulfate, from about 1 to about 10% by weight of a mixture of terminally blocked polyethers corresponding to the following formulae $$R^1-\underset{\underset{R^2}{|}}{CH}-CH_2-O-(C_nH_{2n}O)_x-R^3 \qquad (A)$$

in which $R^1$ is a linear $C_{1-20}$ alkyl radical, $R^2$ is a linear $C_{1-20}$ alkyl radical, $R^3$ is a $C_{1-22}$ alkyl, alkenyl, cycloalkyl, aryl, arylalkyl or alkylaryl radical, n is the number 2, 3 or 4, and x is a number of 2 to 25, and $$R^4-O-(C_nH_{2n}O)_x-R^3 \qquad (B)$$

in which $R^4$ is a $C_{8-22}$ alkyl or alkenyl radical, $R^3$ is a $C_{1-22}$ alkyl, alkenyl, cycloalkyl, aryl, arylalkyl or alkylaryl radical, n is the number 2, 3 or 4, and x is a number of 2 to 25, and 0 to about 5% by weight of a trialkyl phosphate containing 1 to 6 carbon atoms in the alkyl groups wherein the ratio by weight of A to B is between about 0.1 and about 10.

2. A mercerizing or causticizing wetting agent composition as in claim 1 wherein in formulae A and B, $R^1$ is a linear $C_{8-12}$ alkyl radical, $R^2$ is a linear $C_{6-10}$ alkyl radical, $R^3$ is a $C_{1-6}$ alkyl radical and $R^4$ is a $C_{12-18}$ alkyl or alkenyl radical, n is the number 2 and x is a number of 2 to 10.

3. A mercerizing or causticizing wetting agent composition as in claim 1 wherein the ratio by weight of A to B is between about 0.9 and about 1.1.

4. A mercerizing or causticizing wetting agent composition as in claim 1 containing from about 0.5 to about 5% by weight of a trialkyl phosphate having 1 to 6 carbon atoms in the alkyl groups.

5. The process of mercerizing or causticizing cellulose fibers comprising contacting said fibers with a wetting agent composition comprising from about 15 to about 30% by weight of an alkali metal or ammonium salt of 2-ethyl hexyl sulfate, from about 1 to about 10% by weight of a mixture of terminally blocked polyethers corresponding to the following formulae $$R^1-\underset{\underset{R^2}{|}}{CH}-CH_2-O-(C_nH_{2n}O)_x-R^3 \qquad (A)$$

in which $R^1$ is a linear $C_{1-20}$ alkyl radical, $R^2$ is a linear $C_{1-20}$ alkyl radical, $R^3$ is a $C_{1-22}$ alkyl, alkenyl, cycloalkyl, aryl, arylalkyl or alkylaryl radical, n is the number 2, 3 or 4, and x is a number of 2 to 25, and $$R^4—O—(C_nH_{2n}O)_x—R^3 \quad (B)$$

in which $R^4$ is a $C_{8-22}$ alkyl or alkenyl radical, $R^3$ is a $C_{1-22}$ alkyl, alkenyl, cycloalkyl, aryl, arylalkyl or alkylaryl radical, n is the number 2, 3 or 4, and x is a number of 2 to 25, and 0 to about 5% by weight of a trialkyl phosphate containing 1 to 6 carbon atoms in the alkyl groups wherein the ratio by weight of A to B is between about 0.1 and about 10.

6. The process as in claim 5 wherein in formulae A and B, $R^1$ is a linear $C_{8-12}$ alkyl radical, $R^2$ is a linear $C_{6-10}$ alkyl radical, $R^3$ is a $C_{1-6}$ alkyl radical and $R^4$ is a $C_{12-18}$ alkyl or alkenyl radical, n is the number 2 and x is a number of 2 to 10.

7. The process as in claim 6 wherein the ratio by weight of A to B is between about 0.9 and about 1.1.

8. The process as in claim 6 wherein said composition contains from about 0.5 to about 5% by weight of a trialkyl phosphate having 1 to 6 carbon atoms in the alkyl groups.

9. The process as in claim 6 wherein said composition is present in a mercerizing or causticizing liquor in an amount of from about 2 to about 12 grams per liter of said liquor.

10. The process of mercerizing or causticizing cellulose fibers comprising contacting said fibers with a liquor containing from about 2 to about 12 grams of a wetting agent composition per liter of said liquor, said composition comprising from about 15 to about 30% by weight of an alkali metal or ammonium salt of 2-ethyl hexyl sulfate, from about 1 to about 10% by weight of a mixture of terminally blocked polyethers corresponding to the following formulae $$R^1—\underset{\underset{R^2}{|}}{CH}—CH_2—O—(C_nH_{2n}O)_x—R^3 \quad (A)$$

in which $R^1$ is a linear $C_{1-20}$ alkyl radical, $R^2$ is a linear $C_{1-20}$ alkyl radical, $R^3$ is a $C_{1-22}$ alkyl, alkenyl, cycloalkyl, aryl, arylalkyl or alkylaryl radical, n is the number 2, 3 or 4, and x is a number of 2 to 25, and $$R^4—O—(C_nH_{2n}O)_x—R^3 \quad (B)$$

in which $R^4$ is a $C_{8-22}$ alkyl or alkenyl radical, $R^3$ is a $C_{1-22}$ alkyl, alkenyl, cycloalkyl, aryl, arylalkyl or alkylaryl radical, n is the number 2, 3 or 4, and x is a number of 2 to 25, and 0 to about 5% by weight of a trialkyl phosphate containing 1 to 6 carbon atoms in the alkyl groups wherein the ratio by weight of A to B is between about 0.1 and about 10.

11. The process as in claim 10 wherein in formulae A and B, $R^1$ is a linear $C_{8-12}$ alkyl radical, $R^2$ is a linear $C_{6-10}$ alkyl radical, $R^3$ is a $C_{1-6}$ alkyl radical and $R^4$ is a $C_{12-18}$ alkyl or alkenyl radical, n is the number 2 and x is a number of 2 to 10.

12. The process as in claim 10 wherein the ratio by weight of A to B is between about 0.9 and about 1.1.

13. The process as in claim 10 wherein said composition contains from about 0.5 to about 5% by weight of a trialkyl phosphate having 1 to 6 carbon atoms in the alkyl groups.

* * * * *